US008270645B2

(12) United States Patent
Takeda et al.

(10) Patent No.: US 8,270,645 B2
(45) Date of Patent: Sep. 18, 2012

(54) HEARING AID

(75) Inventors: Keiichi Takeda, Ehime (JP); Yosimasa Simogochi, Kanagawa (JP); Minoru Tada, Ehime (JP); Makoto Yagi, Ehime (JP); Fumihiro Asayama, Ehime (JP)

(73) Assignee: Panasonic Corporation, Osaka (JP)

( * ) Notice: Subject to any disclaimer, the term of this patent is extended or adjusted under 35 U.S.C. 154(b) by 129 days.

(21) Appl. No.: 12/865,523

(22) PCT Filed: Mar. 8, 2010

(86) PCT No.: PCT/JP2010/001617

§ 371 (c)(1),
(2), (4) Date: Jul. 30, 2010

(87) PCT Pub. No.: WO2010/103789

PCT Pub. Date: Sep. 16, 2010

(65) Prior Publication Data

US 2010/0290655 A1 Nov. 18, 2010

(30) Foreign Application Priority Data

Mar. 10, 2009 (JP) ..... 2009-056204

(51) Int. Cl.
*H04R 25/00* (2006.01)

(52) U.S. Cl. ..... 381/322; 381/323; 381/324; 381/381; 381/330

(58) Field of Classification Search ..... 381/322, 381/323, 330, 380, 381
See application file for complete search history.

(56) References Cited

U.S. PATENT DOCUMENTS

| | | | | |
|---|---|---|---|---|
| 2007/0081686 | A1 | 4/2007 | Sluppke | |
| 2008/0044049 | A1 * | 2/2008 | Ho et al. | 381/323 |
| 2009/0202092 | A1 * | 8/2009 | Ruppert | 381/323 |

FOREIGN PATENT DOCUMENTS

| | | | |
|---|---|---|---|
| EP | 1 874 091 | | 1/2008 |
| JP | 56-56099 | | 5/1981 |
| JP | 1-160660 | | 11/1989 |
| JP | 2007-172839 | | 7/2007 |
| JP | 2010-220188 | * | 9/2010 |

OTHER PUBLICATIONS

Supplementary European Search Report issued Feb. 2, 2011 in Application No. EP 10 75 0015.
International Search Report issued Apr. 6, 2010 in International (PCT) Application No. PCT/JP2010/001617.

* cited by examiner

*Primary Examiner* — Davetta W Goins
*Assistant Examiner* — Amir Etesam
(74) *Attorney, Agent, or Firm* — Wenderoth, Lind & Ponack, L.L.P.

(57) ABSTRACT

A hearing aid includes a main body and a battery holder that can be opened and closed with respect to the main body by revolving around a revolving shaft. The main body has a lock bar provided so as to traverse the space in which the battery holder is installed, and a protruding portion that protrudes toward this installation space. The battery holder has a first concave portion and a second concave portion that latch the lock bar and the protruding portion.

9 Claims, 6 Drawing Sheets

(a)

(b)

(c)

(a)

(b)

HEARING AID

BACKGROUND OF THE INVENTION

I. Technical Field

The present invention relates to a hearing aid having a battery holder that can be opened and closed from the main body.

II. Description of the Related Art

A button battery is generally used as the power supply for hearing aids.

For example, as disclosed in Japanese Laid-Open Patent Application 2007-172839, a button battery is stored in a battery holder which can be opened and closed with respect to a main body of a hearing aid. With the hearing aid of Japanese Laid-Open Patent Application 2007-172839, a battery holder is locked on the main body side by latching together a convex component provided to the main body of the hearing aid and a concave portion provided to the battery holder.

With the hearing aid of Japanese Laid-Open Patent Application 2007-172839, however, there is the risk that wear or the like to the convex or concave portion when the battery holder is repeatedly opened and closed will diminish the latching performance, preventing the battery holder from being securely locked to the main body.

The present invention was conceived in an effort to solve the above problem, and it is an object thereof to provide a hearing aid with which the battery holder can be securely locked to the main body side even after being repeatedly opened and closed.

SUMMARY OF THE INVENTION

The hearing aid of the present invention comprises a main body, a revolving shaft, a battery holder, a lock bar, a protruding portion, and a latching portion. The revolving shaft is provided to the main body. The battery holder can be opened and closed with respect to the main body by revolving around the revolving shaft. The lock bar is provided to the main body and is provided so as to pass through the storage space in which the battery holder is installed. The protruding portion is provided to the main body and protrudes into the storage space. The latching portion is provided to the battery holder and has a slit, a first concave portion, and a second concave portion. The slit forms a cut-out space for movement of the protruding portion and the lock bar on the main body side when the battery holder is opened or closed with respect to the main body. The first concave portion is disposed on the open end side in the slit and latches the protruding portion and the lock bar. The second concave portion is disposed farther inside the slit than the first concave portion and latches the lock bar in a state in which the protruding portion is latched in the first concave portion.

Also, the hearing aid of the present invention is preferably such that the battery holder is supported in a state of being opened by a specific degree with respect to the main body in a first latched state in which the lock bar is latched in the first concave portion, and is supported in a state of being completely closed with respect to the main body in a second latched state in which the protruding portion is latched in the first concave portion and the lock bar is latched in the second concave portion.

Also, the hearing aid of the present invention is preferably such that the power is on in the second latched state, and the power is off in the first latched state.

Also, the hearing aid of the present invention is preferably such that, if we let R1 be the diameter of the protruding portion and R2 the diameter of the lock bar, the following relation is satisfied.

$$R1>R2$$

Also, the hearing aid of the present invention is preferably such that, if we let r1 be the size of the gap of the slit in the first concave portion, r2 the size of the gap of the slit in the second concave portion, R1 the diameter of the protruding portion, and R2 the diameter of the lock bar, the following relation is satisfied.

$$r1-R1>r2-R2$$

Also, the hearing aid of the present invention is preferably such that, if we let r1 be the size of the gap of the slit in the first concave portion, r2 the size of the gap of the slit in the second concave portion, r3 the size of the gap of the slit at the portion other than the first and second concave portions, R1 the diameter of the protruding portion, and R2 the diameter of the lock bar, the following relation is satisfied.

$$r1\approx r2>R1>R2>r3$$

Also, the hearing aid of the present invention is preferably such that the battery holder is closed by latching first the lock bar and then the protruding portion.

Also, the hearing aid of the present invention is preferably such that the lock bar is formed from metal.

Also, the hearing aid of the present invention is preferably such that the main body is constituted by combining a first housing and a second housing, and the lock bar links the first housing and the second housing.

With the hearing aid of the present invention, the above-mentioned lock bar and protruding portion are used to latch the battery holder to the main body, and the battery holder can be opened and closed from the main body, so the battery holder can be securely locked on the main body side even after being repeatedly opened and closed.

DETAILED DESCRIPTION OF THE PREFERRED EMBODIMENTS

A hearing aid 100 in an embodiment of the present invention will now be described through reference to the drawings.

Figure 1:
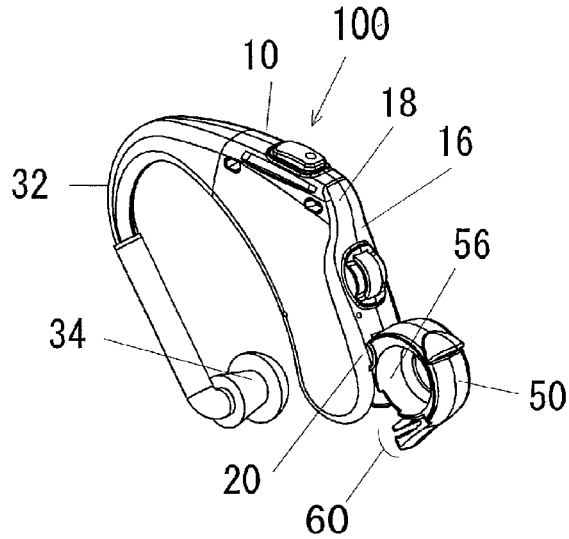
FIG. 1 is perspective views of the hearing aid in an embodiment, in which FIG. 1(*a*) illustrates a state in which the battery holder is open, FIG. 1(*b*) illustrates a state in which the battery holder is closed, and FIG. 1(*c*) is an enlarged perspective view of the battery holder.
Figure 1:
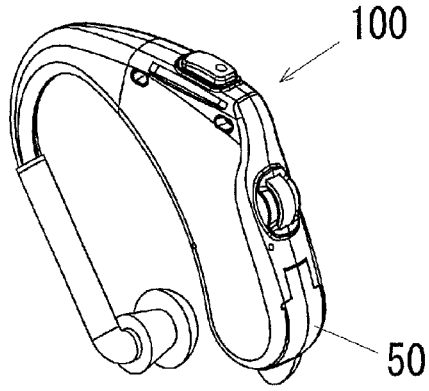
Figure 1:
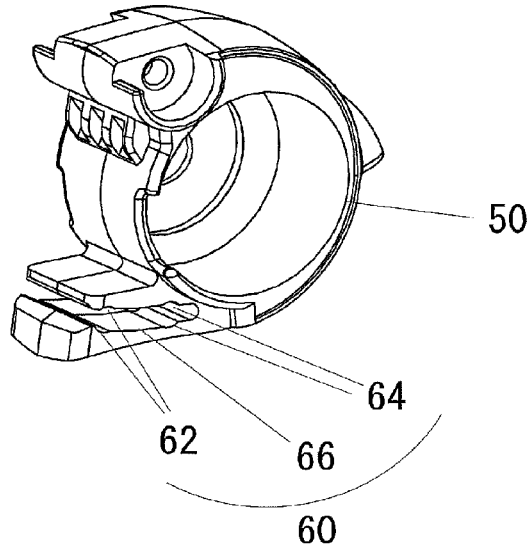
Figure 2:
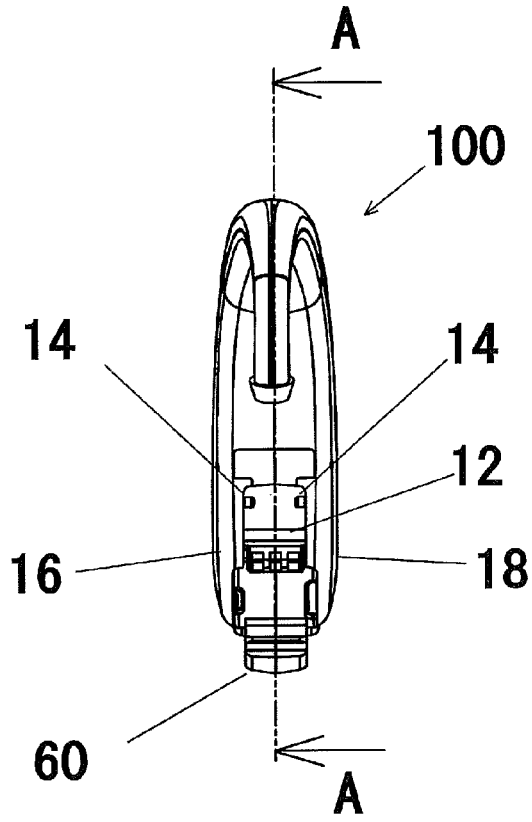
FIGS. 2(*a*) and 2(*b*) are plan views of the hearing aid in FIGS. 1(*a*) and 1(*b*), respectively.
Figure 2:
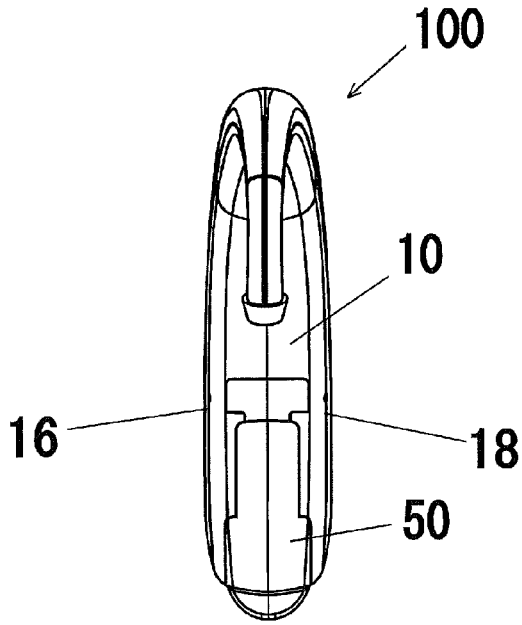

FIG. 1 includes perspective views of the hearing aid 100 in this embodiment. FIGS. 2(*a*) and 2(*b*) are plan views, in the direction of the arrow, of the hearing aid in FIGS. 1(*a*) and 1(*b*), respectively. FIGS. 1(*a*) and 2(*a*) show the state when the battery holder is open. FIGS. 1(*b*) and 2(*b*) show the state when the battery holder is closed. FIG. 1(*c*) is an enlarged perspective view of a battery holder 50.

<Configuration of Hearing Aid 100>

The hearing aid 100 in this embodiment comprises a main body 10 and a battery holder 50 that can be opened and closed with respect to the main body 10, as shown in FIGS. 1(*a*) and 1(*b*).

As shown in FIG. 2(*a*), the main body 10 has a lock bar 12 and two protruding portions 14, 14. The lock bar 12 is provided so as to traverse a storage space for the battery holder 50 formed inside the main body 10, in the thickness direction of a button battery. The two protruding portions 14, 14 have a substantially cylindrical shape, both protrude toward the storage space of the battery holder 50, and are provided at mutually opposite positions via this storage space.

The battery holder 50 is a member that supports a button battery (not shown) and is able to open and close with respect to the main body 10, and has a battery storage section 56 and a latch (latching portion) 60. The button battery (not shown) is installed in the battery storage section 56. The latch 60 latches the two protruding portions 14, 14 and the lock bar 12 provided on the main body 10 side in the course of the closure of the battery holder 50 with respect to the main body 10.

More specifically, as shown in FIG. 1(*c*), the latch 60 has a slit 66 formed so as to be cut out on the inside in the lengthwise direction from the upstream end in the revolving direction when the battery holder 50 is being closed. Also, the latch 60 has a first concave portion 62 that latches the two protruding portions 14, 14, and a second concave portion 64 that latches the lock bar 12, in a state in which the battery holder 50 is closed with respect to the main body 10. The first concave portion 62 and the second concave portion 64 are disposed in the slit 66 in that order, starting from the opening side of the cut-out portion. The first concave portion 62 and the second concave portion 64 are depressions provided on both lateral faces of the cut-out portion forming the slit 66. That is, the slit 66 is wider at the portions where the first concave portion 62 and the second concave portion 64 are formed.

The battery holder 50 is able to open and close with respect to the main body 10 by revolving around a revolving shaft 20. As shown in FIGS. 1(*a*) and 2(*a*), as the battery holder 50 is closed from the state in which it was open with respect to the main body 10, the battery holder 50 revolves around the revolving shaft 20, and the lock bar 12 and the protruding portions 14, 14 steadily move into the slit 66 formed in the battery holder 50. Specifically, the protruding portions 14, 14 and the lock bar 12 on the main body 10 side are disposed along the revolving path of the slit 66 when the battery holder 50 is revolved. When the battery holder 50 is further revolved, the lock bar 12 and the protruding portions 14, 14 are latched by the latch 60 on the battery holder 50 side (the first and second concave portions 62 and 64), and as shown in FIGS. 1(*b*) and 2(*b*), the battery holder 50 is in a closed state.

With the hearing aid 100 in this embodiment, the battery holder 50 is capable of opening and closing with respect to the main body 10 by use of at least two latching mechanisms including the lock bar 12 and the second concave portion 64, the protruding portions 14, 14 and the first concave portion 62. Consequently, the battery holder 50 can be securely closed with respect to the main body 10 even if deformation should occur due to wear of the various components as a result of repeated opening and closing of the battery holder 50.

<Detailed Configuration of Hearing Aid 100>

The configuration of the hearing aid 100 will now be described in detail.

The main body 10 contains a microphone (not shown) for converting a voice signal into an electrical signal, a hearing aid processing circuit (not shown) for amplifying the output signal of the microphone and performing other such hearing aid processing, an earphone circuit (not shown) for converting the output signal of the hearing aid processing circuit into a voice signal, and so forth. Also, the main body 10 has an ear hook 32 and an ear canal insertion portion 34. The main body 10 is constituted by combining a first housing 16 and a second housing 18.

The first housing 16 and the second housing 18 divide the main body 10 approximately in two, evenly on the left and right, at the side face where the battery holder 50 opens and closes. These two are fitted together to constitute the outer shape of the main body 10.

As shown in FIG. 2(*a*), the lock bar 12 is constituted such that rod-shaped members provided on the first housing 16 side and the second housing 18 side are linked when the first and second housings 16 and 18 are fitted together. That is, the lock bar 12 is provided so as to traverse the storage space inside the first and second housings 16 and 18, in the space provided between the first housing 16 and the second housing 18 for installing the battery holder 50.

Consequently, the lock bar 12 makes it possible to perform positioning while maintaining the space between the first and second housings 16 and 18, and attachment looseness (error) between the first housing 16 and the second housing 18 can be minimized. Also, since the lock bar 12 is formed by butting together rod-shaped members formed on the first and second housings 16 and 18, in a state in which the first housing 16 and the second housing 18 have been fitted together, there will be less offset of the first housing 16 and the second housing 18 to the inside (the battery holder 50 side) due to deformation or the like, so the space for installing the battery holder 50 can be effectively ensured.

The main body 10 and the battery holder 50 are molded from plastic, for example.

The lock bar 12 may also be molded from plastic, but it is preferably formed from metal. Generally, metals have more strength than plastics, so this prevents deformation or breakage of the main body 10. However, if the lock bar 12 and the protruding portions 14, 14 are both made of metal, the plastic members (the latch 60) on the battery holder 50 side will be more prone to wear. Accordingly, it is preferable to mold the protruding portions 14, 14 from plastic. This will reduce deformation due to wear of the latch 60 on the battery holder 50 side. Furthermore, the protruding portions 14, 14 may be molded integrally with the plastic main body 10.

With the hearing aid 100 of this embodiment, two sets of latching mechanisms are used which include the lock bar 12 and the second concave portion 64, the protruding portions 14, 14 and the first concave portion 62, but another latching mechanism may also be added. In this case, though, the positioning of the latching mechanisms becomes more complicated, and a problem is that even greater positioning accuracy is required. Also, if a third concave portion is provided to the latch 60 of the battery holder 50, another problem is that the strength of the latch 60 will decrease. Because of the above, providing two sets of latching mechanisms is adequate as in this embodiment.

As shown in FIG. 2(*a*), the protruding portions 14, 14 are preferably formed on the farthest downstream side in the direction in which the battery holder 50 is closed, in the space inside the main body 10 for installing the battery holder 50. This more effectively prevents misalignment of the battery holder 50 with respect to the main body 10 in a state in which the battery holder 50 has been completed closed. The lock bar 12 is preferably disposed at a position farther upstream in the direction in which the battery holder 50 is closed than the above-mentioned position on the farthest downstream side. When momentum is taken into account, this securely supports the two housings 16 and 18 and improves impact resistance.

The sizes r1 and r2 of the gaps in the slit 66 at the first concave portion 62 and the second concave portion 64 (the sizes of the gaps between opposing depressions provided to the slit 66) are designed to be substantially the same.

$$r1 \approx r2 \quad (1)$$

Figure 5:
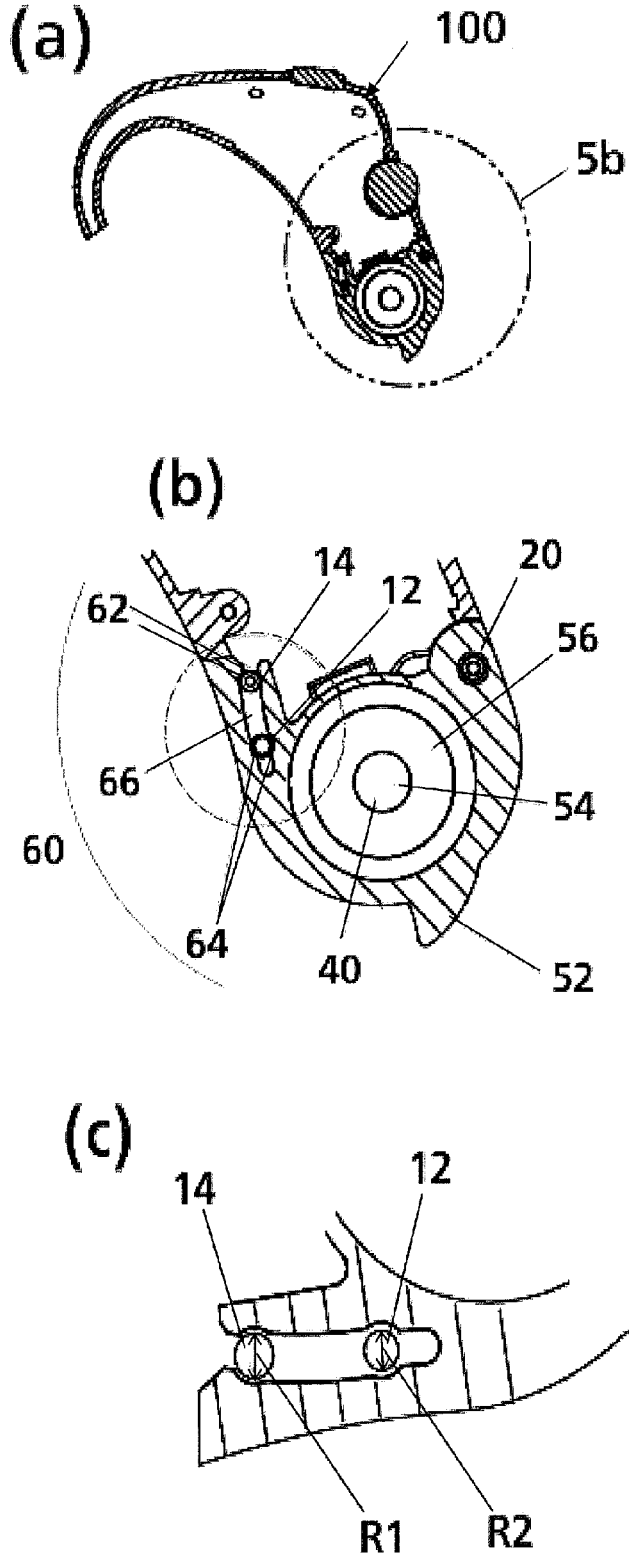
FIG. 5 is cross-sectional views of the battery holder in a completely closed state, in which FIG. 5(*a*) is an overall view, FIG. 5(*b*) is a partial enlarged view of FIG. 5(*b*), and FIG. 4(*c*) is a partial enlarged views illustrating the positional relation between the lock bar, the protruding portion, and the latch in a state in which the battery holder is completely closed in FIG. 5(*b*)

Also, as indicated by the following relational formula (2), the diameter R2 of the substantially cylindrical lock bar 12 is designed to be less than the diameter R1 of the similarly substantially cylindrical protruding portions 14, 14 (see FIG. 5(*c*)).

$$R1 > R2 \quad (2)$$

Here, in a state in which the battery holder 50 has been completely closed with respect to the main body 10, the force with which the latch 60 attempts to close (the force with which parts of the latch 60 that are opposite each other with the slit 66 in between move closer together) is greater toward the deeper part of the slit 66 than at the distal end side. This is because the deeper part of the slit 66 is closer to the connected portion of the slit 66 (its base) in the latch 60.

If the lock bar 12 and the protruding portions 14, 14 are designed so as to satisfy the above-mentioned relational formulas 1 and 2, then the size of the gap in the slit 66 will be greater on the lock bar 12 side (the deeper side) than on the protruding portions 14, 14 side (the opening side), as shown in FIG. 5(*c*).

Consequently, an adequate gap is ensured near the lock bar 12 on the deeper side of the slit 66, so the base portion of the slit 66 will be less likely to be subjected to a load, which means the latch 60 will be less apt to deform. This avoids a situation in which too much load from the lock bar 12 is exerted on the latch 60, so that the battery holder 50 does not close properly. Also, as shown in FIG. 5(*c*), inside the slit 66, a large gap is ensured between the lock bar 12 and the second concave portion 64, and this gap also has the effect of absorbing variance in the molded sizes of the main body 10 and the battery holder 50.

Furthermore, the lock bar 12, unlike the protruding portions 14, 14, must move through the narrow slit 66 while the battery holder 50 is being closed with respect to the main body 10. Thus, since the lock bar 12 is smaller in diameter than the protruding portions 14, 14, the lock bar 12 can move smoothly through the slit 66.

Also, if we let r3 be the size of the gap of the slit 66 at the portion other than the first and second concave portions 62 and 64, then r1, r2, r3, R1, and R2 are preferably designed so as to satisfy the following relational formula (3).

$$r1 \approx r2 > R1 > R2 > r3 \quad (3)$$

In this embodiment, the magnitude relation between r1, r2, R1, and R2 can also be defined as the following relational formula (4).

$$r1 - R1 < r2 - R2 \quad (4)$$

Consequently, in a state in which the battery holder 50 has been completely closed with respect to the main body 10, an adequate gap is ensured near the lock bar 12 on the deeper side of the slit 66. Accordingly, load is less likely to be exerted at the base portion of the slit 66, so the latch 60 is less prone to deformation. This avoids a situation in which too much load from the lock bar 12 is exerted on the latch 60, so that the battery holder 50 does not close properly, among other such effects that can be similarly obtained.

Also, when the diameter R2 of the lock bar 12 is greater than the gap r3 of the slit 66, an opening force produced by elastic deformation of the latch 60 (the force with which the opposing members of the latch 60 move away from each other) acts while the lock bar 12 is moving through the slit 66. Accordingly, the lock bar 12 can move smoothly through the slit 66 under the elastic deformation of the latch 60 (see FIG. 4(*d*)).

<Opening and Closing of Battery Holder 50>

The opening and closing of the battery holder 50 will now be described through reference to FIGS. 3(*a*) to 5(*c*).

Figure 3:
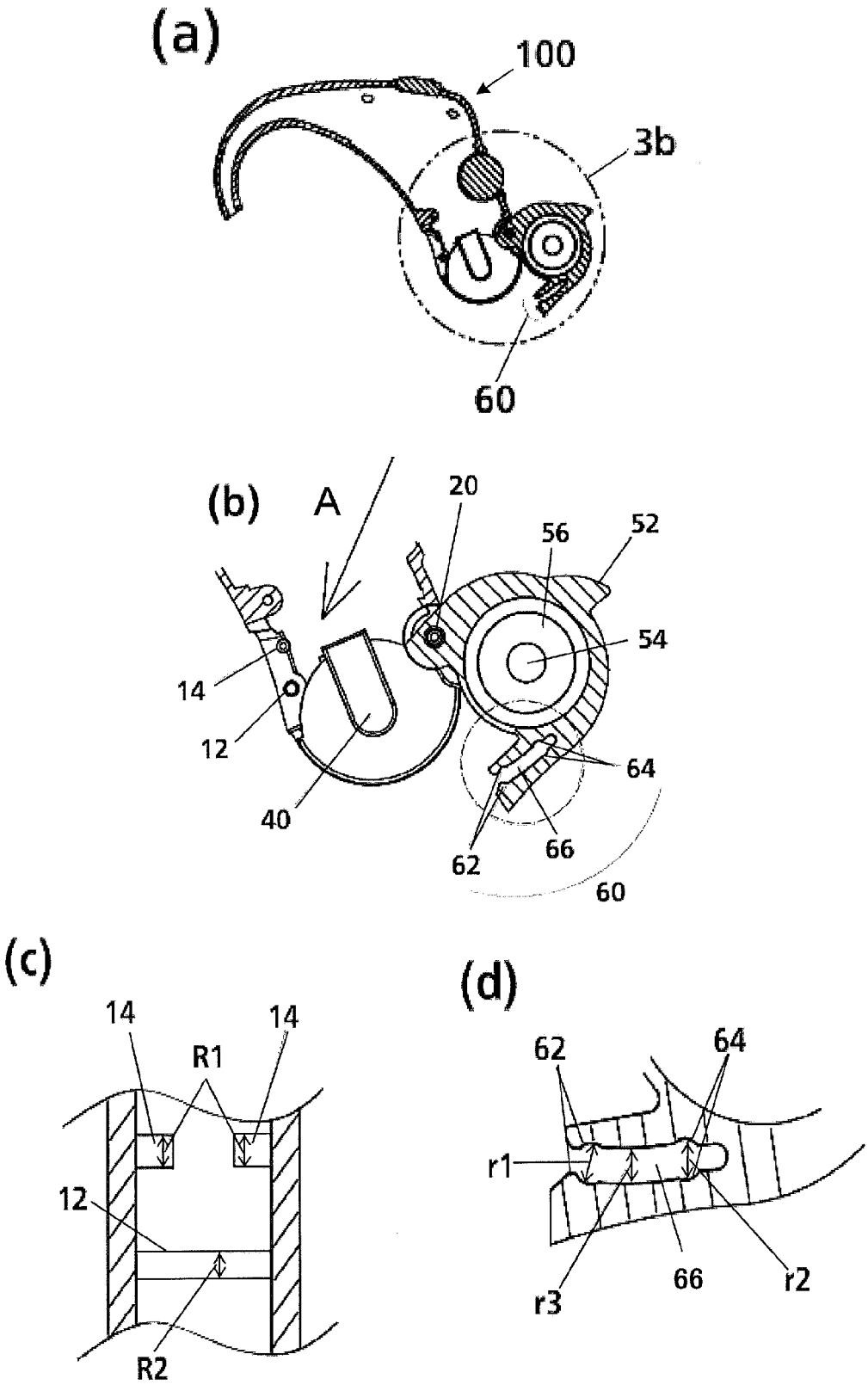
FIG. 3 is cross-sectional views of the battery holder in a completely open state, in which FIG. 3(*a*) is an overall view, FIG. 3(*b*) is a partial enlarged view of FIG. 3(*a*), FIG. 3(*c*) is a view in the A direction in FIG. 3(*b*), and FIG. 3(*d*) is a partial enlarged view of the latch in FIG. 3(*b*)
Figure 4:
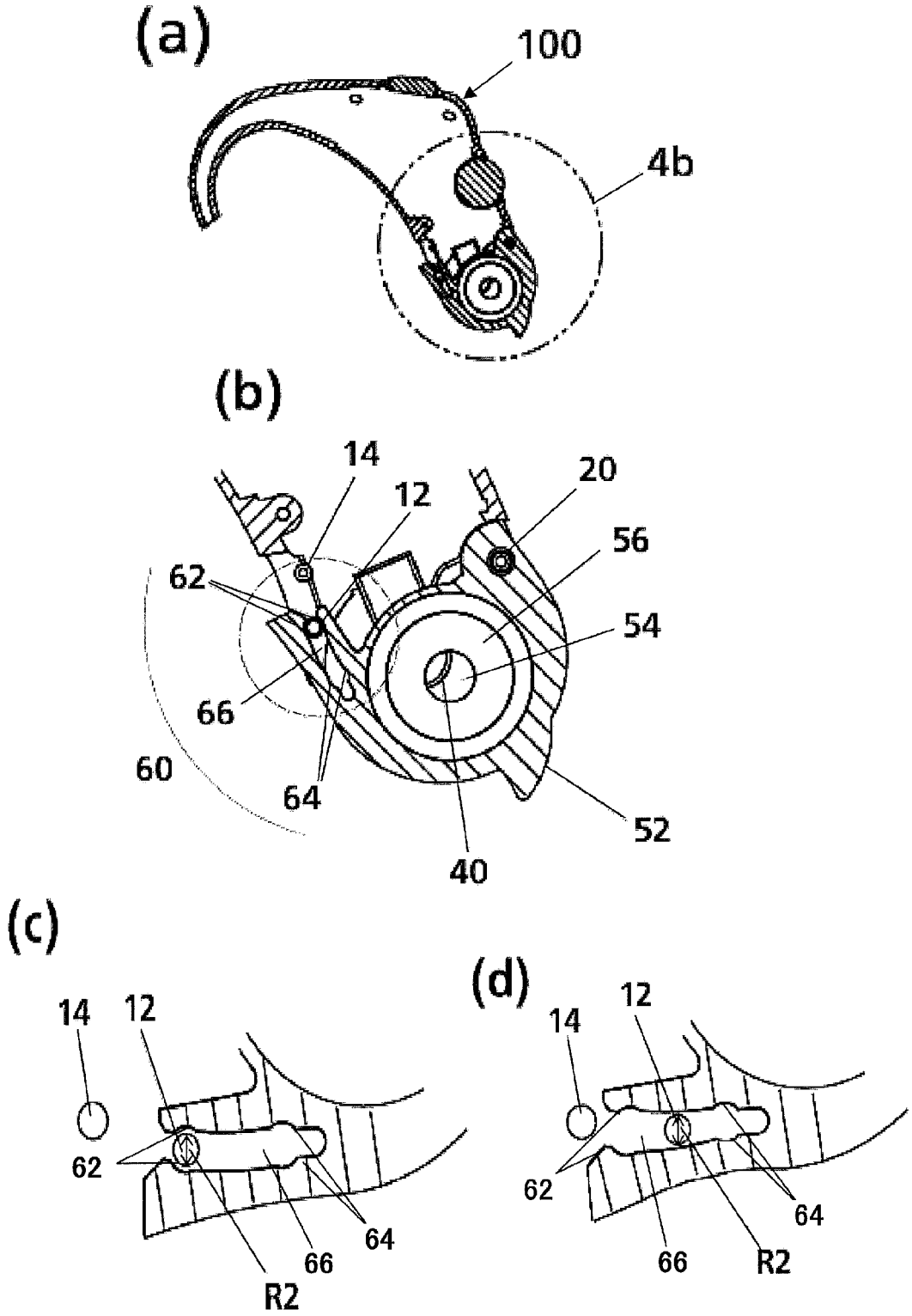
FIG. 4 is cross-sectional views of the battery holder in a partially closed state, in which FIG. 4(*a*) is an overall view, FIG. 4(*b*) is a partial enlarged view of FIG. 4(*a*), and FIGS. 4(*c*) and 4(*d*) are partial enlarged views illustrating the positional relation between the lock bar, the protruding portion, and the latch as the battery holder is closed in FIG. 4(*b*)

FIG. 3(*a*) is a cross-sectional view illustrating the state in which the battery holder 50 has been opened fully with respect to the main body 10. FIG. 4(*a*) is a cross-sectional view of the state in which the battery holder 50 has been closed to a certain point with respect to the main body 10. FIG. 5(*a*) is a cross-sectional view of the state in which the battery holder 50 has been closed completely with respect to the main body 10. FIGS. 3(*a*), 4(*a*), and 5(*a*) are all cross-sectional views along the A-A line in FIG. 2. FIGS. 3(*b*), 4(*b*), and 5(*b*) are enlarged views of the 3*b* portion in FIG. 3(*a*), the 4*b* portion in FIG. 4(*a*), and the 5*b* portion in FIG. 5(*a*), respectively. FIG. 3(*c*) is a view from the A direction in FIG. 3(*b*). FIG. 3(*d*) is an enlarged partial view of the latch in FIG. 3(*b*). FIGS. 4(*c*) and 4(*d*) are enlarged partial views of the positional relation between the lock bar 12, the protruding portions 14, 14, and the latch 60 as the battery holder 50 is closed in FIG. 4(*b*). FIG. 5(*c*) is an enlarged view of the positional relation between the lock bar 12, the protruding portions 14, 14, and the latch 60 in a state in which the battery holder 50 has been completely closed in FIG. 5(*b*).

As shown in FIG. 3(*a*), in a state in which the battery holder 50 has been fully opened with respect to the main body 10, when an opening/closing tab 52 on the battery holder 50 is pressed down, the battery holder 50 revolves clockwise around the revolving shaft 20. When the battery holder 50 revolves clockwise, the lock bar 12 passes through the slit 66 while widening the gap of the slit 66 after the opening-side distal end of the slit 66 of the battery holder 50 comes into contact with the lock bar 12.

As shown in FIGS. 4(*b*) and 4(*c*), the lock bar 12 is latched by fitting into the depression of the first concave portion 62 formed on the upstream side in the slit 66. Here, the latched state of the lock bar 12 in the first concave portion 62 shown in FIGS. 4(*b*) and 4(*c*) will be called the first latched state.

When the opening/closing tab 52 is further pressed down with a finger from the first latched state shown in FIG. 4(*c*), the battery holder 50 further revolves clockwise around the revolving shaft 20, and the lock bar 12 rides up over the first concave portion 62 and moves through the slit 66. Then, as shown in FIG. 4(*d*), the protruding portions 14, 14 move to the position where the protruding portions 14, 14 touch the distal ends on the opening side of the slit 66, and move on through the slit 66.

Finally, as shown in FIGS. 5(*a*), 5(*b*), and 5(*c*), the lock bar 12 fits into and latches the depressions of the second concave portion 64, and the protruding portions 14, 14 fit into and latch the depressions of the first concave portion 62. Here, the fully closed state in which the lock bar 12 and the protruding portions 14, 14 are latched with respect to the respective first and second concave portions 62 and 64 shown in FIGS. 5(*a*) to 5(*c*) will be called the second latched state.

In this embodiment, in the second latched state in which the protruding portions 14, 14 are latched in the first concave portion 62 and the lock bar 12 in the second concave portion 64, the battery holder 50 is considered to be in its fully closed state.

Consequently, the battery holder 50 can be securely fixed to the main body 10 by two sets of latching mechanisms. With this embodiment, the battery holder 50 can be supported by the two sets of latching mechanisms even when the battery holder 50 has been repeatedly opened and closed, so this avoids a situation in which wear, deformation, or the like prevents the battery holder 50 from closing tightly.

As discussed above, when opening and closing are performed in two stages, between the second latched state in which the battery holder 50 is completely closed with respect to the main body 10, the first latched state in which it is open to a certain degree, and a state in which it is completely open, normally three concave portions (latching portions) need to be provided on the latch 60 side. As modern hearing aids have become smaller and lighter in weight, the latches have generally become smaller and more slender members. Accordingly, when three concave portions (latching portions) are formed, the strength of the latches ends up being greatly diminished. The stiffness of the latches also decreases, and as a result, the latches exert less closing force (the force with which the opposing latches move closer together), and there is the risk that a completely closed state or latched state cannot be effectively realized.

With the hearing aid 100 of this embodiment, when the battery holder 50 is opened and closed, the lock bar 12 and the protruding portions 14, 14 are latched in a single concave portion (the first concave portion 62) formed on the opening side of the slit 66 according to the degree of openness.

Consequently, even when the battery holder 50 is opened and closed in two stages, there is no need to form three concave portions on the latch 60, which is a slender, small member. As a result, adequate stiffness can be ensured for the latch 60, and a hearing aid 100 with which the battery holder 50 can be opened and closed in two stages can be obtained.

Also, in the second latched state, an opening 54 provided to the bottom of the battery holder 50 is at a position that overlaps a metal terminal 40 inside the main body 10, and a button battery (not shown) contained in the battery holder 50 is electrically connected with the metal terminal 40. Consequently, the hearing aid 100 is in an operable state, that is, a power-on state.

Conversely, when the battery holder 50 is opened from the second latched state, the opening/closing tab 52 is pushed up with a finger, and the battery holder 50 revolves counter-clockwise around the revolving shaft 20. That is, the battery holder 50 operates in the opposite way compared to the above-mentioned closing mechanism with respect to the main body 10.

In other words, when there is a transition from the second latched state to the first latched state, the region of overlap between the opening 54 and the metal terminal 40 on the inside of the main body 10 becomes steadily smaller. When there is a transition to the first latched state, it becomes the state of non-region of overlap between the opening 54 and the metal terminal 40, the electrical connection between the button battery and the metal terminal 40 is broken, and the hearing aid 100 enters an inoperable state, that is, a power-off state. In this first latched state, the button battery is not completely exposed from the main body 10, so the button battery will not fall out.

<How to use of the Hearing Aid 100>

The method for using the hearing aid 100 will now be described.

Figure 6:
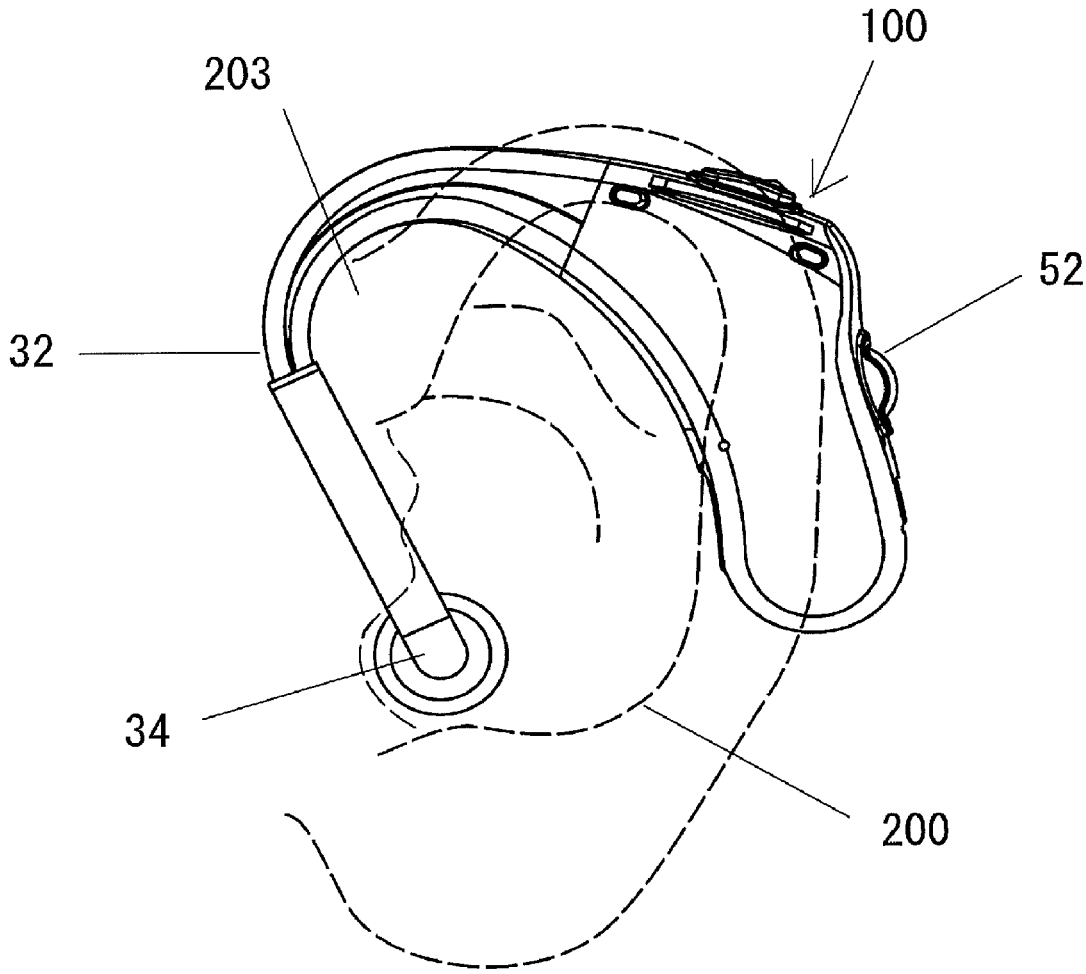
FIG. 6 is a schematic diagram illustrating how to use the hearing aid in FIG. 1.

As shown in FIG. 6, the user places the hearing aid 100 to the rear of the ear auricle 200, latches the ear hook 32 to the top of the base 203 of the ear auricle 200, and inserts the ear canal insertion portion 34 into the ear canal.

When use of the hearing aid 100 is begun, the user puts the battery holder 50, with the button battery in place, in a closed state with respect to the main body 10. The hearing aid 100 is at that point in a power-on state and ready to use. Conversely, when use of the hearing aid 100 is stopped, the user lifts up the opening/closing tab 52 and revolves the battery holder 50 counter-clockwise around the revolving shaft 20, thereby opening the battery holder 50 until the above-mentioned first latched state (see FIG. 4(*c*), etc.) is reached. Consequently, the hearing aid 100 enters a power-off state, and its use can be ended. Thus, if the user should experience any discomfort due to sounds that can be heard when moving into an environment with noisy surroundings, the hearing aid 100 can be temporarily switched off merely by revolving the battery holder 50 slightly. As a result, discomfort to the user can be easily eliminated in noisy environments and so forth.

With the hearing aid 100 in this embodiment, the degree to which the battery holder 50 is opened in the first latched state can be varied according to the position on the main body 10 at which the lock bar 12 is disposed. Specifically, the openness of the battery holder 50 in the first latched state can be adjusted.

Also, the first latched state is preferably set to a degree of openness at which a transition can be made with a simple operation of the opening/closing tab 52, while still preventing the button battery from falling out of the battery holder 50. Therefore, the position of the lock bar 12 in the main body 10 is preferably set so that the battery holder 50 will enter the first latched state when revolved counter-clockwise from its closed state within an approximate range of at least 15 degrees to no more than 20 degrees.

Consequently, even if the user temporarily turns off the power to the hearing aid 100, the openness of the battery holder 50 can be adjusted in the first latched state within a range in which the button battery will not fall out of the battery holder 50.

With the hearing aid 100 of this embodiment, the opening and closing of the battery holder 50 with respect to the main body 10 is made possible by using two latching mechanisms comprising the lock bar 12 and the protruding portions 14, 14 with respect to the first and second concave portions 62 and 64.

This means that the battery holder 50 can be securely closed even after being repeatedly opened and closed. Thus, switching the power on and off to the hearing aid 100 can be accurately controlled by the opening and closing of the battery holder 50.

A type of hearing aid that is hooked onto the ear was given as an example in the above embodiment, but the hearing aid of the present invention can also be widely applied to other types of hearing aid besides those that are hooked onto the ear.

Other Embodiments

An embodiment of the present invention was described above, but the present invention is not limited to the above embodiment, and various modifications are possible without departing from the gist of the invention.

(A)

In the above embodiment, an example was described in which the diameters R1 and R2 of the lock bar 12 and the protruding portions 14, 14, which were engaged in the first and second concave portions 62 and 64 and were formed on the main body 10 side, were designed to satisfy the above-mentioned Relational Formula 2. However, the present invention is not limited to or by these.

For instance, the values may be such that R1<R2, as opposed to Relational Formula 2 given above.

In general, for reasons related to molding, the second concave portion 64 that is closer to the linked part of the latch 60 (the base of the slit 66) can be formed with a more accurately sized gap than that of the first concave portion 62.

Accordingly, when the relation R1<R2 is satisfied, then in a state in which the battery holder 50 is closed with respect to the main body 10, the size of the gap formed between the second concave portion 64 and the lock bar 12 (=r2−R2) can be made smaller than the size of the gap formed between the first concave portion 62 and the protruding portions 14, 14 (=r1−R1). As a result, looseness of the battery holder 50 can be eliminated, and the battery holder 50 can be securely held in a closed state.

(B)

In the above embodiment, an example was described in which the rod-shaped lock bar 12, which linked the first and second housings 16 and 18 formed on the latch 60 side, and the protruding portions 14, 14, which were formed so as to leave a gap between the first and second housings 16 and 18, were used as members on the main body 10 side and latched by the first and second concave portions 62 and 64 formed on the latch 60 side. However, the present invention is not limited to this.

For instance, rod-shaped members similar to the lock bar 12 may be used instead of the protruding portions 14, 14.

(C)

In the above embodiment, an example was described in which two substantially cylindrical protruding members formed on the first and second housings 16 and 18, respectively, were used as the protruding portions 14, 14. However, the present invention is not limited to this.

For instance, a single member protruding from either the first or the second housing may be provided as the protruding portion.

The present invention can be widely applied to hearing aids comprising a battery holder that can be opened and closed with respect to a main body by being revolved around a revolving shaft.

The invention claimed is:

1. A hearing aid, comprising:

a main body having a storage space;

a revolving shaft disposed in the main body;

a battery holder configured to be opened and closed with respect to the main body by revolving around the revolving shaft, and being configured to be installed in the storage space;

a lock bar disposed in the main body and being configured and arranged to pass through the storage space;

a protruding portion that disposed in the main body and protruding into the storage space; and a latching portion disposed on the battery holder and having a slit forming a cut-out space, the slit having a first concave portion disposed on an open end side and a second concave portion disposed farther inside the slit relative to the first concave portion, the latching portion moving relative to the protruding portion and the lock bar on the main body when the battery holder is opened or closed with respect to the main body, the first concave portion being configured to latch to the protruding portion and the lock bar, and the second concave portion being configured to latch to the lock bar when the protruding portion is latched in the first concave portion.

2. The hearing aid according to claim 1, wherein the battery holder is configured so as to be capable of being opened by a specific angle with respect to the main body in a first latched state in which the lock bar is latched in the first concave portion, and is configured so as to be completely closed with respect to the main body in a second latched state in which the protruding portion is latched in the first concave portion and the lock bar is latched in the second concave portion.

3. The hearing aid according to claim 2, wherein in the second latched state, power is on, and in the first latched state, the power is off.

4. The hearing aid according to claim 1, wherein, a diameter of the protruding portion is R1, and a diameter of the lock bar is R2, and the following relation is satisfied:

$$R1>R2.$$

5. The hearing aid according to claim 1, wherein, a size of the gap of the slit in the first concave portion is r1, a size of the gap of the slit in the second concave portion is r2, a diameter of the protruding portion is R1, and a diameter of the lock bar is R2, and the following relation is satisfied:

$$r1-R1>r2-R2,$$

6. The hearing aid according to claim 1, wherein, a size of the gap of the slit in the first concave portion is r1, a size of the gap of the slit in the second concave portion is r2, a size of the gap of the slit at the portion other than the first and second concave portions is r3, a diameter of the protruding portion is R1, and a diameter of the lock bar is R2, and the following relation is satisfied:

$$r1\approx r2>R1>R2>r3,$$

7. The hearing aid according to claim 1, wherein, the latching portion is configured and arranged such that first the lock bar and then the protruding portion are latched in the first and second concave portions, respectively, when the battery holder is closed.

8. The hearing aid according to claim 1, wherein the lock bar metal.

9. The hearing aid according to claim 1, wherein the main body is a combination of a first housing and a second housing, and the lock bar links the first housing and the second housing.

* * * * *

UNITED STATES PATENT AND TRADEMARK OFFICE

CERTIFICATE OF CORRECTION

PATENT NO. : 8,270,645 B2
APPLICATION NO. : 12/865523
DATED : September 18, 2012
INVENTOR(S) : Keiichi Takeda It is certified that error appears in the above-identified patent and that said Letters Patent is hereby corrected as shown below:

In column 10, line 40, "r1 - R1 > r2 - R2," should read --r1 - R1 > r2 - R2.--

In column 10, line 49, "r1 ≈ r2 > R1 > R2 > r3," should read --r1 ≈ r2 > R1 > R2 > r3.--.

In column 10, line 57, "the lock bar metal" should read --the lock bar is metal--.

Signed and Sealed this
Nineteenth Day of February, 2013

Teresa Stanek Rea
*Acting Director of the United States Patent and Trademark Office*